United States Patent [19]

Beckmann

[11] Patent Number: 4,465,406

[45] Date of Patent: Aug. 14, 1984

[54] MINE ROOF SUPPORT UNIT

[75] Inventor: Klaus Beckmann, Lunen, Fed. Rep. of Germany

[73] Assignee: Gewerkschaft Eisenhutte Westfalia, Lunen, Fed. Rep. of Germany

[21] Appl. No.: 302,552

[22] Filed: Sep. 16, 1981

[30] Foreign Application Priority Data

Sep. 19, 1980 [DE] Fed. Rep. of Germany ..... 3035423

[51] Int. Cl.[3] ..... E21D 23/08

[52] U.S. Cl. ..... 405/296; 405/299

[58] Field of Search ..... 405/296, 293, 294, 295, 405/292, 291, 297, 299, 300, 301; 299/32

[56] References Cited

U.S. PATENT DOCUMENTS 4,231,684 11/1980 Oppenlander et al. ..... 405/295

FOREIGN PATENT DOCUMENTS 984790 3/1965 United Kingdom ..... 405/291

1056690 1/1967 United Kingdom ..... 299/32

605017 4/1978 U.S.S.R. ..... 405/291

*Primary Examiner*—David H. Corbin

*Attorney, Agent, or Firm*—Thompson, Birch, Gauthier & Samuels

[57] ABSTRACT

A mine roof support unit has a roof bar supported on a floor sill by hydraulic props. The floor sill is constituted by a face-side floor sill part and a goaf-side floor sill part. The two floor sill parts are telescopically interconnected. Each of the floor sill parts supports a pair of hydraulic props. Hydraulic rams are provided for moving each of floor sill parts relative to the other floor sill part in the direction of roof support unit advance.

14 Claims, 5 Drawing Figures

FIG.1
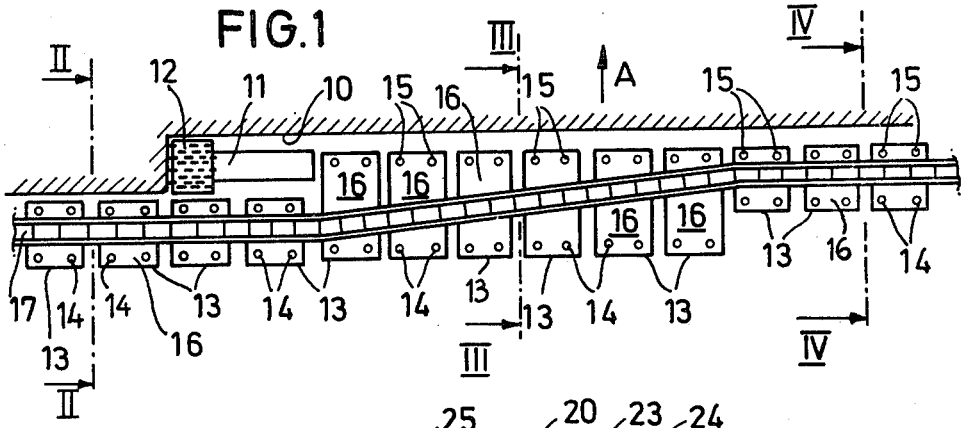
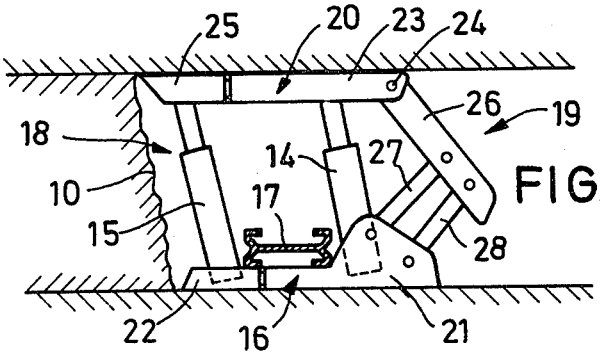
FIG.2
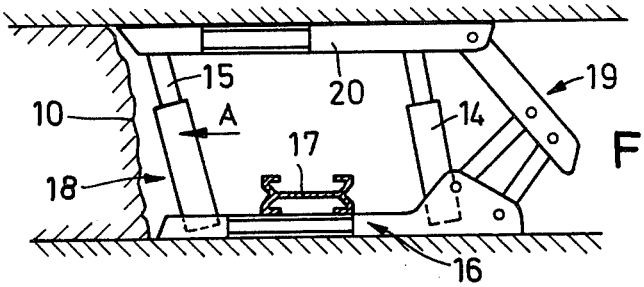
FIG.3
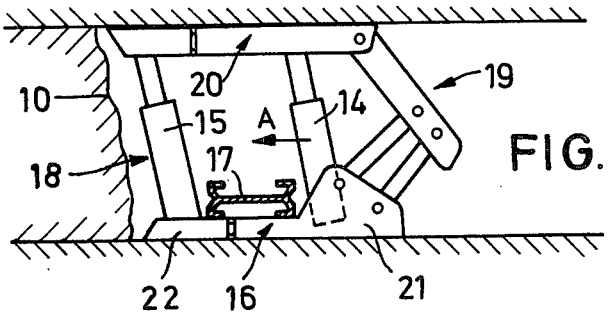
FIG.4

MINE ROOF SUPPORT UNIT

BACKGROUND TO THE INVENTION

This invention relates to a mine roof support unit, and to a longwall mineral mining installation incorporating mine roof support units.

A longwall mineral mining installation typically comprises a longwall conveyor, a winning machine movable to and fro along the longwall face, and a plurality of roof support units for supporting the roof of the working. Each of the roof support units has a roof bar supported on a floor sill by hydraulic props. When such an installation is used for winning coal, the roof support units are usually positioned on the goaf side of the conveyor, and a winning machine (such as a plough) is movable to and fro along the face side of the conveyor. In order to support the roof of the longwall working in the region adjacent to the face, the roof bars are provided with extension caps. These extension caps are pivotally or slidably mounted on their respective roof bars. Unfortunately, the load-bearing capacity of such an extension cap is relatively small, and is often insufficient to provide effective roof support when depressions or cracks occur in this critical roof zone adjacent to the face.

In order to improve the load-bearing capacity of mine roof support units in the region adjacent to the face, it is known to support the roof bars by means of hydraulic props positioned immediately in front of the face. With this arrangement, the roof can be supported reliably, even under difficult conditions. (See DE-PS No. 1 143 721, DE-AS No. 1 583 083 & DE-AS No. 1 205 031).

A known installation incorporating roof support units of this type is provided with advance mechanisms for advancing the roof support units. The roof support units of each adjacent pair are interconnected by means of a respective advance mechanism, each advance mechanism being used to advance its two associated roof support units in turn. In this case, the conveyor is carried by the floor sills of the roof support units, and is positioned between the face-side props and a row of props positioned at the goaf side of the roof support units. (See DE-Gbm No. 1 886 508).

The disadvantage of this known type of installation is that the distance through which the roof support units can be advanced is relatively small. The advance distance is considerably less than the distance between the face-side props and the goaf-side props. Consequently, the width of the working (that is to say the distance between the face and the goaf) is relatively large.

The aim of the invention is to provide a roof support unit that can reliably support the roof in the region adjacent to the face, and which can be advanced by a relatively large distance without the need for an excessively wide working.

SUMMARY OF THE INVENTION

The present invention provides a mine roof support unit having a roof-engageable structure supported on a floor sill by hydraulic props, wherein the floor sill is constituted by a face-side floor sill part and a goaf-side floor sill part, the two floor sill parts being telescopically interconnected, each of the floor sill parts supporting at least one hydraulic prop, and each of the floor sill parts being movable relative to the other floor sill part in the direction of roof support unit advance.

Advantageously, the roof-engageable structure is constituted by a roof bar having a face-side roof bar part and a goaf-side roof bar part, the two parts of the roof bar being telescopically interconnected and being independently movable in the direction of roof support unit advance, and wherein each roof bar part is supported upon a respective floor sill part by at least one hydraulic prop. Preferably, each roof bar part is supported on its respective floor sill part by two hydraulic props.

This roof support unit thus provides adequate roof support both at the face and goaf regions of the working. Moreover, such a roof support unit can be advanced by a distance which corresponds to the distance between its face-side and goaf-side props.

Advantageously, the unit further comprises a goaf shield positioned between the goaf side of the roof-engageable structure and the goaf side of the goaf-side floor sill part. Preferably, the goaf shield is pivotally attached to the goaf side of the roof-engageable structure, and the goaf shield is connected to the goaf side of the goaf-side floor sill part by means of a lemniscate linkage. The goaf shield helps to reduce the width of the working.

Conveniently, the unit further comprises hydraulic ram means for advancing the floor sill parts relative to one another.

Preferably, one of the floor sill parts is constituted by a generally U-shaped frame member, and the other floor sill part is constituted by a base web and a pair of parallel beams extending substantially at right-angles to the base web, the parallel beams of the other floor sill part being spaced apart by such a distance that they are a sliding telescopic fit within the arms of the U-shaped frame member constituting said one floor sill part. Conveniently, said one floor sill part is the goaf-side floor sill part. In this case, said hydraulic ram means may be constituted by a pair of hydraulic rams, and each of the hydraulic rams may be positioned within a respective arm of the U-shaped frame member.

Advantageously, each of the floor sill parts is provided with a top cover plate, the two top cover plates being arranged to overlap one another in a telescopic sliding manner.

The invention also provides a longwall mineral mining installation comprising a longwall conveyor and plurality of roof support units, the roof support units being positioned side-by-side, and each of the roof support units being as defined above, wherein the conveyor is supported on the floor sills of the roof support units and is positioned between the hydraulic props associated with the face-side floor sill parts and the hydraulic props associated with the goaf-side floor sill parts.

With this type of installation, the roof support units are only extended (that is to say their floor sill parts are telescoped apart) only in a relatively short region close to the winning machine that moves along the face. In this region, the conveyor has an S-shaped configuration. The conveyor is preferably constituted by a plurality of sections joined together end-to-end.

Advantageously, each of the roof support units is provided with hydraulic advance ram means for advancing the conveyor section supported by that roof support unit. Preferably, the hydraulic advance ram means of each roof support unit is constituted by a hydraulic advance ram arranged below the associated conveyor section and within the floor sill of that unit. Conveniently, the piston rod of the hydraulic advance ram of each roof support unit is attached to the associated conveyor section at the face side thereof. In this case, the hydraulic advance ram of each roof support unit may be arranged between the two arms of the U-shaped frame member constituting said one floor sill part of that roof support unit, the piston rod of that hydraulic advance ram being aligned with the gap left between the parallel beams of the associated other floor sill part. This results in a space-saving arrangement.

BRIEF DESCRIPTION OF THE DRAWINGS

A mine roof support assembly incorporating roof support units constructed in accordance with the invention will now be described, by way of example, with reference to the accompanying drawings, in which:

FIG. 1 is a diagrammatic plan view of part of the roof support assembly;

FIG. 2 is a cross-section taken on the line II—II of FIG. 1;

FIG. 3 is a cross-section taken on the line III—III of FIG. 1;

FIG. 4 is a cross-section taken on the line IV—IV of FIG. 1; and

DESCRIPTION OF PREFERRED EMBODIMENT

Figure 5:
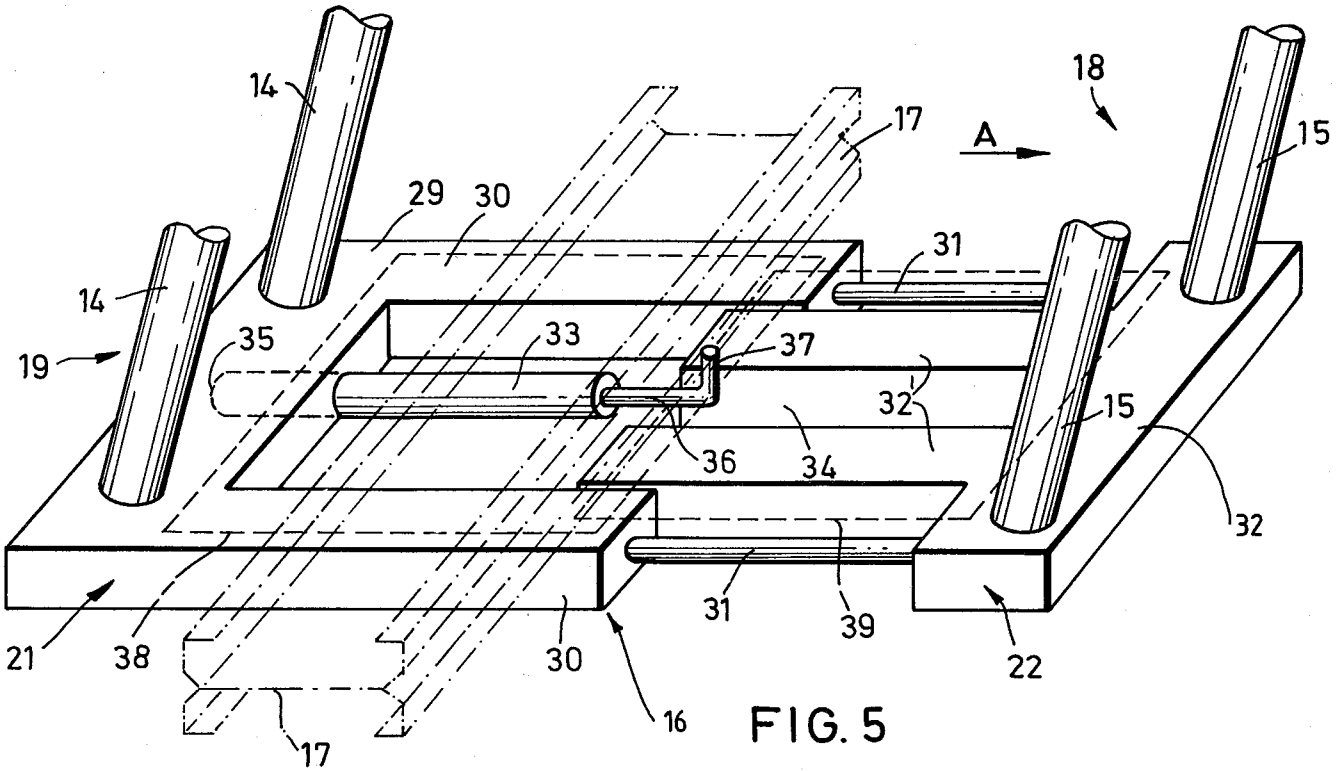
FIG. 5 is a perspective view of the floor sill of one of the roof support units of the assembly.

Referring to the drawings, FIG. 1 shows a longwall mine working having a longwall face 10. A winning machine 11 is movable to and fro along the face 10 to win mineral material such as coal. The winning machine 11 is provided with a rotatable cutting drum 12. A roof support assembly is provided for supporting the roof of the longwall working, the roof support assembly being constituted by a plurality of roof support units 13 which are positioned side-by-side. Each of the roof support units 13 can be advanced individually in the direction A of face advance.

As best seen in FIGS. 2 to 4, each roof support unit 13 is of two-part construction. Thus, each unit 13 has a face-side part 18 and a goaf-side part 19. Each face-side part 18 has a pair of hydraulic props 15, and each goaf-side part 19 has a pair of hydraulic props 14. The props 14 and 15 are each arranged in a row which extends the entire length of the longwall working. The props 14 serve to support the roof of the working at some distance from the face 10, whereas the props 15 support the roof immediately adjacent to the face. In this way, the roof of the working is reliably supported even in the immediate vicinity of the face 10.

Each of the roof support units 13 has a floor sill 16 which supports the hydraulic props 14 and 15 of that unit. The floor sills 16 of the roof support units 13 also support a scraper-chain conveyor 17, the conveyor being positioned between the row of props 14 and the row of props 15. FIG. 1 shows the portion of the roof support assembly which is in the region of the winning machine 11. To the rear (that is to say to the right as seen in FIG. 1) of the winning machine 11 the conveyor 17 has been advanced towards the newly exposed face 10, so that the conveyor forms a flat S-curve when seen in plan.

The two parts 18 and 19 of each roof support unit 13 are relatively movable, in the direction A of face advance, so that the units can have different lengths. This enables the conveyor 17 to take up its S-shaped configuration in the region of the winning machine 11. Thus, just to the rear of the winning machine 11, the roof support units 13 are fully extended, so that their props 14 and 15 are at their greatest distance apart with their props 15 located immediately in front of the region of the face 10 that has just been won. Forwardly and rearwardly of this region, the roof support units 13 are fully retracted, so that their props 14 and 15 are closest together with their props 15 located immediately in front of the face 10. Consequently, the roof support units 13 are extended in the relatively small region adjacent to the winning machine 11. This results in the working having a relatively small width, so that a relatively small roof area needs to be supported. Obviously, as the winning machine 11 moves forward (that is to say to the left as seen in FIG. 1), the unextended roof support units 13 adjacent thereto are extended one by one, and the extended units at the right-hand end of the extended group of units are retracted one by one. Thus, the S-shaped portion of the conveyor 17 moves along the working with the winning machine 11.

As best seen in FIGS. 2 to 4, the sill 16 of each roof support unit 13 is of a two-part telescopic construction. Similarly, each roof support unit 13 has a two-part, telescopic roof bar 20. Each sill 16 is constituted by a sill part 21 forming a portion of the goaf-side roof support part 19, and a sill part 22 forming a portion of the face-side roof support unit part 18. The sill parts 21 and 22 are provided with universal joints (not shown) for supporting the props 14 and 15 respectively. Similarly, each roof bar 20 has a goaf-side roof bar part 23, and a face-side roof bar part 25. The roof bar parts 23 and 25 are supported by the props 14 and 15 respectively. Moreover, each goaf-side roof support unit part 19 is provided with a goaf shield 26 which is pivotally attached, at 24, to the associated goaf-side roof bar part 23. Each goaf shield 26 is attached to the associated goaf-side floor sill part 21 by means of lemniscate guide links 27 and 28.

FIG. 2 shows one of the roof support units 13 which is forward (that is to say to the left as seen in FIG. 1) of the winning machine 11. This roof support unit 13 is in its retracted position, in which its props 14 and 15 are relatively closely spaced.

FIG. 3 shows one of the roof support units 13 which lies just to the rear (that is to say to the right as seen in FIG. 1) of the wining machine 11. In order to bring a given roof support unit 13 into the position shown in FIG. 3 (from the position shown in FIG. 2), its part 18 is moved forward with respect to its part 19. This is accomplished immediately after the winning machine 11 has moved past that roof support unit 13. Obviously, before advancing the roof support unit part 18, its props 15 are relaxed to permit this advance movement. After this advance movement, the props 15 are re-pressurised so that the associated face-side roof bar part 25 is forced firmly against the roof of the working adjacent to the newly exposed face 10. After its props 15 have been pressurised, the section of the conveyor 17 resting on the floor sill 16 of that roof support unit 13 is advanced, in steps, to form part of the S-shaped configuration.

FIG. 4 shows one of the roof support units 13 which lies to the rear (that is to say to the right as seen in FIG. 1) of the S-shaped portion of the conveyor 17. This unit 13 is in the same (retracted) position as that shown in FIG. 2. In order to bring a given roof support unit 13 into the position shown in FIG. 4 (from the position shown in FIG. 3), its part 19 is advanced, in a follow-up step, relative to its part 18. Obviously, before advancing the roof support unit part 19, its props 14 are relaxed. From a comparison of FIGS. 2 to 4, it will be apparent that each of the roof support units 13 can make a relatively large advance step. In particular, each of the units 13 can be advanced over a distance which corresponds to the depth of cut of the winning machine 11.

FIG. 5 illustrates the formation of the telescopic floor sill 16 of one of the roof support units 13. The goaf-side floor sill part is constituted by a generally U-shaped frame member having a base web 29 and a pair of spaced parallel arms 30. The hydraulic props 14 are supported by the base web 29. A respective hydraulic ram (not shown) is provided within each of the arms 30. The piston rods 31 of the hydraulic rams extend beyond the free ends of the arms 30, and are attached to the corresponding face-side floor sill part 22. These two hydraulic rams can, therefore, be used to advance the face-side floor sill part 18 to follow the advance of the face 10, and then to advance the goaf-side floor sill part 19 in a follow-up movement.

The face-side floor sill part 22 has a base web 32 and a pair of spaced, parallel beams 32'. The beams 32' are spaced apart so as to be a sliding telescopic fit within the arms 30 of the U-shaped frame member constituting the goaf-side floor sill part 21. The beams 32' define an elongate aperture 34 which is aligned with a hydraulic advance ram 33, the cylinder of which is supported, at 35, in the base web 29 of the U-shaped goaf-side floor sill part 21. The piston rod 36 of the advance ram 33 is attached to the section of the conveyor 17 (shown in dash-dot lines in FIG. 5) carried by the floor sill 16 by means of a coupling member 37. The coupling member 37 extends upwardly with respect to the piston rod 36, and projects upwardly beyond the upper surface of the floor sill 16. The coupling member 37 is attached to the conveyor section at the face-side thereof. Thus, when the ram 33 is extended, its piston rod 36 is moved outwards, and the associated conveyor section is advanced in the direction A, that is to say towards the already-advanced roof support unit part 18. When fully advanced, the conveyor section lies immediately behind the props 15 on the beams 32'. The goaf-side roof support unit part 19 can then be advanced, in a follow-up step, by retracting the rams associated with the piston rods 31. This is effective to pull the U-shaped floor sill part 21 under the advanced conveyor section.

The floor sill parts 21 and 22 are provided with top cover plates 38 and 39 respectively (shown in dash-dot lines in FIG. 5). These cover plates 38 and 39 form a support on which the associated conveyor section can slide. The cover plates 38 and 39 are arranged to slide over one another during relative movement between the two floor sill parts 21 and 22.

Although not shown in the drawings, the roof bar 20 of each roof support unit 13 is of a similar telescopic sliding construction as the floor sill 16.

I claim:

1. A longwall mineral mining installation comprising a longwall conveyor and plurality of roof support units, the roof support units being positioned side-by-side, and each of the roof support units having a roof-engageable structure supported on a floor sill by hydraulic props, the floor sill of each roof support unit comprising a face-side floor sill part and a goaf-side floor sill part, advance means for telescopically interconnecting the two parts of each floor sill, each of the floor sill parts supporting at least one hydraulic prop, and each of the floor sill parts being movable by said advance means relative to the associated floor sill part in the direction of roof support unit advance, the conveyor being supported on the floor sills of the roof support units and being positioned between the hydraulic props associated with the face-side floor sill parts and the hydraulic props associated with the goaf-side floor sill parts.

2. A mineral mining installation according to claim 1, wherein the conveyor is constituted by a plurality of sections joined together end-to-end.

3. A mineral mining installation according to claim 1, wherein the roof-engageable structure of each roof support unit comprises a roof bar having a face-side roof bar part and a goaf-side roof bar part, the two parts of each roof bar being telescopically interconnected and being independently movable in the direction of roof support unit advance, and wherein each roof bar part is supported upon a respective floor sill part by at least one hydraulic prop.

4. A mineral mining installation according to claim 3, wherein each roof bar part is supported on its respective floor sill part by two hydraulic props.

5. A mineral mining installation according to claim 1, wherein each roof support unit is provided with a goaf shield positioned between the goaf side of the roof-engageable structure and the goaf side of the goaf-side floor sill part of that roof support unit.

6. A mineral mining installation according to claim 5, wherein each goaf shield is pivotally attached to the goaf side of the associated roof-engageable structure, and wherein each goaf shield is connected to the goaf side of the associated goaf-side floor sill part by means of a lemniscate linkage.

7. A mineral mining installation according to claim 1, wherein each roof support unit is provided with hydraulic ram means for advancing its floor sill parts relative to one another.

8. A mineral mining installation according to claim 7, wherein one of the floor sill parts of each roof support unit comprises a generally U-shaped frame member and the other floor sill part of that roof support unit comprises a base web and a pair of parallel beams extending substantially at right-angles to the base web, the parallel beams of each said other floor sill part being spaced apart by such a distance that they are a sliding telescopic fit within the arms of the associated U-shaped frame member.

9. A mineral mining installation according to claim 8, wherein each of the roof support units is provided with hydraulic advance ram means for advancing the conveyor section supported by that roof support unit.

10. A mineral mining installation according to claim 9, wherein the hydraulic advance ram means of each roof support unit comprises a hydraulic advance ram arranged below the associated conveyor section and within the floor sill of that unit.

11. A mineral mining installation according to claim 10, wherein the piston rod of the hydraulic advance ram of each roof support unit is attached to the associated conveyor section at the face side thereof.

12. A mineral mining installation according to claim 10 or claim 11, wherein the hydraulic advance ram of each roof support unit is arranged between the two arms of the U-shaped frame member which comprise said one floor sill part of that roof support unit, and wherein the piston rod of that hydraulic advance ram is aligned with the gap left between the parallel beam of the associated other floor sill part.

13. A mineral mining installation according to claim 1 wherein said floor sill parts have interengageable projections which telescopically slide over one another and which define a support surface for the conveyor.

14. A longwall mineral mining installation comprising a longwall conveyor constituted by a plurality of sections joined together end-to-end and a plurality of roof support units, the roof support units being positioned side-by-side, and each of the roof support units having a roof-engageable structure supported on a floor sill, each roof-engageable structure comprising a roof bar having a face-side roof bar part and a goaf side roof bar part, the two parts of each roof bar being telescopically interconnected and being independently movable in the direction of roof support unit advance, the floor sill of each roof support unit comprising a face-side floor sill part and a goaf-side floor sill part, the two parts of each floor sill being telescopically interconnected and being independently movable in the direction of roof support unit advance, each roof bar part being supported upon a respective floor sill part by at least one hydraulic prop, the conveyor being supported on the floor sills of the roof support units and being positioned between the hydraulic props associated with the face-side floor sill parts and the hydraulic props associated with the goaf-side floor sill parts, each roof support unit being provided with a goaf shield positioned between the goaf side of the roof-engageable structure and the goaf side of the goaf side floor sill part of that roof support unit, each goaf shield being pivotally attached to the goaf side of the associated roof-engageable structure, and wherein each goaf shield is connected to the goaf side of the associated goaf-side floor sill by means of a lemniscate linkage.

* * * * *